US006158962A

United States Patent [19]

Lee et al.

[11] Patent Number: 6,158,962

[45] Date of Patent: Dec. 12, 2000

[54] TURBINE BLADE WITH RIBBED PLATFORM

[75] Inventors: Ching-Pang Lee, Cincinnati; George A. Durgin, West Chester; James H. Laflen, Loveland; Steven R. Brassfield, Cincinnati, all of Ohio

[73] Assignee: General Electric Company, Cincinnati, Ohio

[21] Appl. No.: 09/302,967

[22] Filed: Apr. 30, 1999

[51] Int. Cl.[7] ..... B63H 1/16

[52] U.S. Cl. ..... 416/193 A; 416/244 A

[58] Field of Search ..... 416/193 A, 191, 416/244 R, 244 A, 248

[56] References Cited

U.S. PATENT DOCUMENTS

| | | | |
|---|---|---|---|
| 4,019,832 | 4/1977 | Salemme et al. | 416/193 A |
| 5,284,421 | 2/1994 | Chlus et al. | 416/500 |

*Primary Examiner*—Edward K. Look
*Assistant Examiner*—Hermes Rodriguez
*Attorney, Agent, or Firm*—Andrew C. Hess; Rodney M. Young

[57] ABSTRACT

The present invention provides a gas turbine engine blade having a dovetail, a shank extending radially outward from the dovetail, and a platform joined to the shank. An inner surface of the platform faces radially inwardly and an opposite outer surface of the platform faces radially outwardly. An airfoil extends radially outwardly from the platform and has pressure and suction airfoil sides that define pressure and suction blade sides of the blade. The platform extends axially between leading and trailing platform edges and transversely between pressure and suction side platform edges of the platform. At least one transversely extending bracing rib is in a corner of the shank and the platform between one of the blade sides and the inner surface of the platform. The preferred embodiment further includes the bracing rib, the shank, and the platform being integrally cast. The bracing rib is preferably wider along the platform and the shank than at a distal edge of the rib. In one embodiment this may is accomplished with fillets in triangular corners formed by the rib, platform, and shank. The rib, preferably, includes tapered rib sides that are tapered in a radially inwardly direction away from the platform and in the transverse direction away from the shank. The rib is preferably on the pressure side of the blade.

12 Claims, 1 Drawing Sheet

TURBINE BLADE WITH RIBBED PLATFORM

BACKGROUND OF THE INVENTION

1. Field of the Invention

The present invention relates generally to gas turbine engine blades and, more particularly, to turbine blade cooling and turbine blade platforms.

2. Discussion of the Background Art

A gas turbine engine includes a compressor for pressurizing air which is channeled to a combustor wherein it is mixed with fuel and ignited for generating hot combustion gas. The combustion gas flows downstream through one or more turbine stages which extract energy therefrom for producing work. A typical turbine blade includes a dovetail disposed in a complementary dovetail slot in a perimeter of a disk of a turbine rotor for securing the blade thereto. A shank extends radially outwardly from the dovetail to a platform which defines a radially inner flowpath for the combustion gas. The airfoil extends radially outwardly from the platform for extracting energy from the combustion gas for rotating the disk and producing power.

Turbine blades are directly exposed to the hot combustion gases and are typically cooled using a portion of compressed air bled from the compressor and channeled through a cooling circuit within the airfoil of the blade. For high performance gas turbines having substantially high combustion gas temperature, the turbine blade utilizes various film cooling holes over an airfoil thereof for providing thin films of cooling air to protect the airfoil from the hot combustion gas which flows thereover.

The blade may be cooled by variously configured cooling circuits and cooling holes through the airfoil. The cooling circuit extends from the bottom of the dovetail which first receives the coolant channeled thereto, and extends upwardly through the dovetail, shank, platform, and airfoil. The cooling circuit itself provides effective cooling of the dovetail, shank, and platform since they are disposed radially inwardly of the combustion gas flowpath.

The hottest combustion gas typically flows near the mid-span region of the airfoil and first engages the airfoil along its leading edge and pressure and suction sides. Accordingly, the leading edge and pressure and suction sides of the airfoil are typically provided with suitable film cooling holes for maximizing the cooling thereof for effecting a suitably long useful life of the blade during operation.

The efficiency of the gas turbine engine may be further increased by increasing the temperature of the combustion gas, which correspondingly increases the difficulty of cooling the turbine blade. Undesirable exhaust emissions may be reduced by providing substantially flat temperature profiles for the combustion gas exiting the combustor which reduces the center-peaked temperature and effects a more radially uniform, yet high temperature, profile. This further increases the complexity of adequately cooling the turbine blade since the heat load is being distributed more uniformly from the root to tip of the airfoil.

In particular, conventional blade platforms are relatively thin plate members which have no internal cooling circuits therein. The platform is conventionally cooled solely by the coolant channeled upwardly through the shank and center of the platform into the airfoil. Accordingly, conventional uncooled blade platforms are subject to substantial thermal distress in advanced, low emission turbine engines. However, since the platforms are relatively thin and project outwardly from the airfoil, providing cooling circuits therein, while maintaining suitable strength thereof is a significant problem.

New high performance gas turbines are being designed with lower solidity or less airfoils than have been used in the past. These turbine blades require more airflow turning for each airfoil from the leading edge to the trailing edge. The larger turning results in a longer or wider platform overhang as measured from the shank. This, in turn, requires an increase in the thickness of the platform in order to accommodate or withstand the centrifugal force loading of the platform under high rotating speeds of the rotor. The platforms are subject to heating from the main gas flowpath above the platform and cooling by the rotor cooling air under the platform. The increased platform thickness will increase the undesirable weight and platform temperature. It is, therefore, desirable to have a design which can avoid or reduce the increase of the platform thickness and yet still can maintain the mechanical strength under the high rotational speed condition. It is also desirable to have a platform design that does not require cooling holes or passages therethrough.

SUMMARY OF THE INVENTION

The present invention provides a gas turbine engine blade having a dovetail, a shank extending radially outward from the dovetail, and a platform joined to the shank. An airfoil extends radially outwardly from the platform and has pressure and suction airfoil sides that define pressure and suction blade sides of the blade. The platform extends axially between leading and trailing platform edges and transversely between pressure and suction side platform edges of the platform. An inner surface of the platform faces radially inwardly and an opposite outer surface of the platform faces radially outwardly. At least one transversely extending bracing rib is in a corner of the shank and the platform between one of the blade sides and the inner surface of the platform.

The preferred embodiment includes the bracing rib, the shank, and the platform being integrally cast. The bracing rib is preferably wider along the platform and the shank than at a distal edge of the rib. The bracing rib, preferably, has fillets in triangular corners formed by the rib, platform, and shank. The rib, preferably, includes tapered rib sides that are tapered in a radially inwardly direction away from the platform and in a transverse direction away from the shank. The rib is preferably on the pressure side of the blade. A cooled blade embodiment further includes a cooling circuit extending radially outwardly through the dovetail, shank, platform, and airfoil for circulating a coolant therethrough for cooling the blade. The gas turbine engine blade preferably includes two or more of the bracing ribs wherein the bracing ribs are spaced apart and parallel.

ADVANTAGES OF THE INVENTION

The present invention improves performance of the turbine and engine, while accommodating hot gas flows, while avoiding the need or reducing the requirement for complicated film cooling and other cooling schemes that require hole drilling in and/or machining of the platform. The additional structural support from the ribs allows a reduction in the thickness of the platform. The reduction of thickness and the increased cooling surface area results in a cooler platform temperature to prevent the need of further complicated cooling schemes. The present invention is inexpensive because the ribs are an integrally cast part of the blade and, therefore, a minimal effect on casting cost.

BRIEF DESCRIPTION OF THE DRAWINGS

The novel features believed characteristic of the present invention are set forth and differentiated in the claims. The invention, together with further objects and advantages thereof, is more Particularly described in conjunction with the accompanying drawings in which:

DETAILED DESCRIPTION

Figure 3:
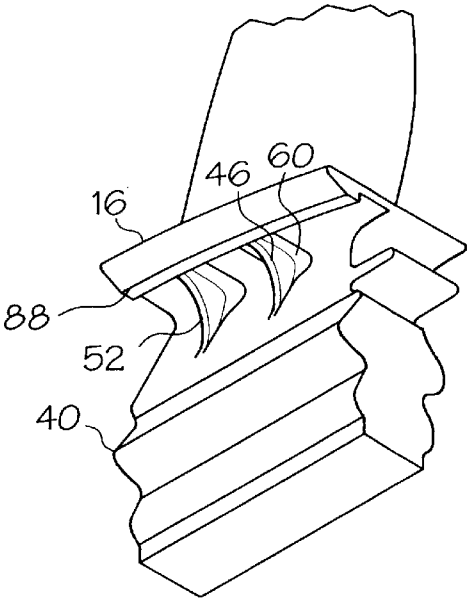
FIG. 3 is a perspective view illustration of a bracing rib in FIG. 1.
Figure 2:
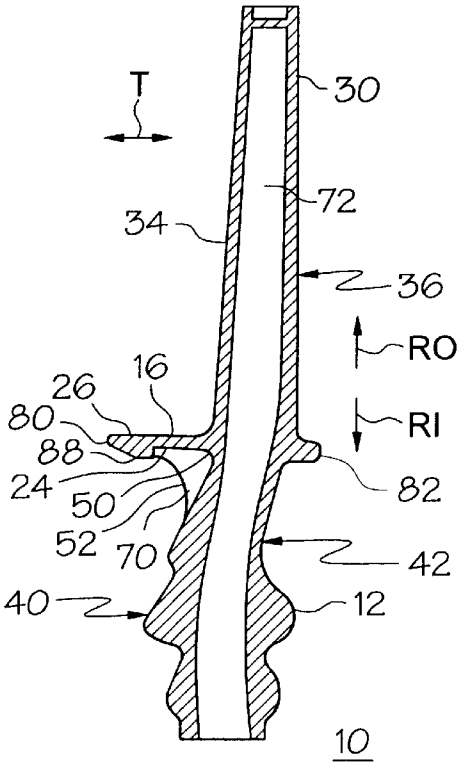
FIG. 2 is a radial sectional view of the turbine blade illustrated in FIG. 1 and taken generally along line 2—2.
Figure 1:
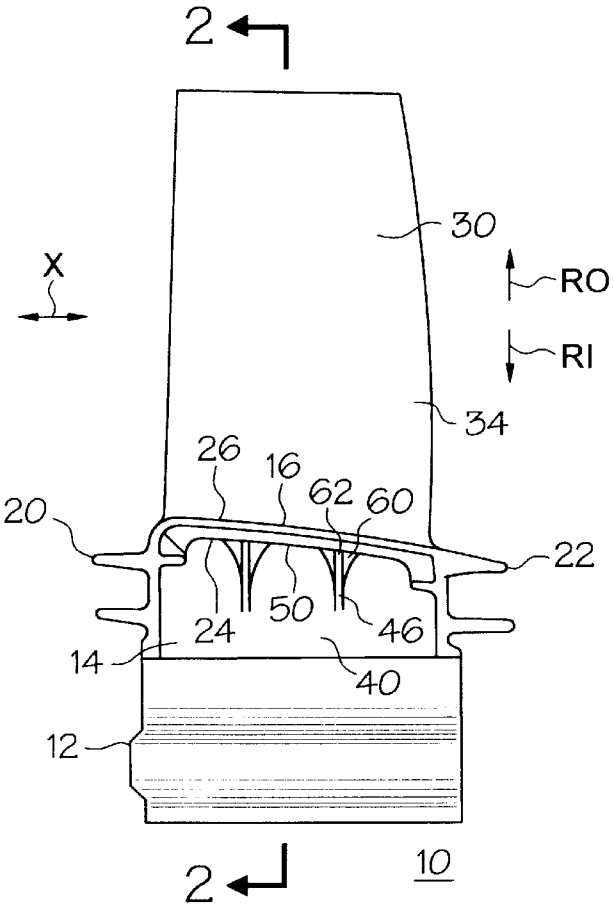
FIG. 1 is an elevational, pressure-side view illustration cf an exemplary embodiment of a turbine blade of the present invention for providing enhanced platform cooling.

Illustrated in FIGS. 1, 2, and 3 is a gas turbine engine blade exemplified by a turbine blade 10 having a dovetail 12, a shank 14 extending radially outward from the dovetail and, a platform 16 joined to the shank. An inner surface 24 of the platform faces radially inwardly RI and an opposite outer surface 26 of the platform faces radially outwardly RO. An airfoil 30 extends radially outwardly RO from the platform 16 and has pressure and suction airfoil sides 34 and 36, respectively, that define pressure and suction blade sides 40 and 42, respectively, of the blade 10.

The platform 16 extends in an axial direction X between leading and trailing platform edges 20 and 22, respectively, and in a transverse direction T between pressure and suction side platform edges 80 and 82, respectively, which are transversely spaced apart from the pressure and suction blade sides 40 and 42, respectively.

At least one transversely extending bracing rib 46 is in a corner 50 of the shank 14 and the platform 16 between one of the pressure and suction blade sides 40 and 42, respectively, and the inner surface 24 of the platform. The preferred embodiment preferably has at least two of the bracing ribs 46 as illustrated herein, and may have more, wherein the bracing ribs are axially spaced apart and parallel.

The preferred embodiment includes the bracing ribs 46, the shank 14, and the platform 16 being integrally cast. Each of the bracing ribs 46 is preferably wider along the platform 16 and the shank 14 than at a distal edge 52 of each of the ribs. This wider portion of the bracing rib 46 can be described as fillets 60 (or as gussets) in triangular corners 62 formed by the rib 46, platform 16, and shank 14. This gives the ribs 46 tapered rib sides 70 that are tapered in a radially inwardly RI direction away from the platform 16 and in the tangential direction T away from the shank 14. The ribs are tapered to have stronger joint at the platform and the shank. These ribs are the integral part of the shank and the platform. They are cast together with the blade in one casting process. The ribs provide structural support to the platform and an increased cooling surface area. Fillet generally is defined as a concave transition surface between two otherwise intersecting surfaces but for the purpose of this patent, the fillet does not have to be concave. A fillet weld, for example, joins two edges at right angles such that its cross-sectional configuration is approximately triangular. The fillet 60 of the present invention are broad in definition and cover a variety of transition surface shapes including concave and flat.

An overhang 88 is located at one of the pressure and suction side platform edges 80 and 82, respectively, which in the preferred embodiment is the pressure side platform edge. The bracing rib 46 preferably extends transversely all the way to the overhang 88 located at the pressure side platform edge 80.

The rib is preferably on the pressure side 40 of the blade 10. The embodiment of the invention illustrated herein includes a cooled airfoil and blade that has a cooling circuit 72 extending radially outwardly RO through the dovetail 12, shank 14, platform 16, and airfoil 30 for circulating a coolant therethrough for cooling the blade. Reference may be had to U.S. Pat. No. 5,738,489, which is incorporated herein by reference, for more information on various types of cooling circuits contemplated by the present invention.

While there have been described herein what are considered to be preferred and exemplary embodiments of the present invention, other modifications of the invention shall be apparent to those skilled in the art from the teachings herein and, it is therefore, desired to be secured in the appended claims all such modifications as fall within the true spirit and scope of the invention.

Accordingly, what is desired to be secured by Letters Patent of the United States is the invention as defined and differentiated in the following claims.

What is claimed is:

1. A gas turbine engine blade comprising:

a dovetail;

a shank extending radially outward from said dovetail;

a platform joined to said shank, said platform extending axially between leading and trailing platform edges of said platform and transversely between pressure and suction side platform edges of said platform;

an inner surface of said platform facing radially inwardly and an opposite outer surface of said platform facing radially outwardly;

an airfoil extending radially outwardly from said platform and having pressure and suction airfoil sides that define pressure and suction blade sides of said blade; and at least one transversely extending bracing rib in a corner of said shank and said platform between one of said blade sides and said inner surface of said platform.

2. A blade as claimed in claim 1 wherein said bracing rib, said shank, and said platform are integrally cast.

3. A blade as claimed in claim 2 wherein said bracing rib has fillets in triangular corners formed by said rib, platform, and shank.

4. A blade as claimed in claim 3 wherein said rib includes tapered rib sides that are tapered in a radially inwardly direction away from said platform and in a transverse direction away from said shank.

5. A blade as claimed in claim 4 wherein said one of said blade sides is said pressure side.

6. A blade as claimed in claim 5 further comprising a cooling circuit extending radially outwardly through said dovetail, shank, platform, and airfoil for circulating a coolant therethrough for cooling said blade.

7. A gas turbine engine blade comprising:

a dovetail;

a shank extending radially outward from said dovetail;

a platform joined to said shank, said platform extending axially between leading and trailing platform edges of said platform and transversely between pressure and suction side platform edges of said platform;

an inner surface of said platform facing radially inwardly and an opposite outer surface of said platform facing radially outwardly;

an airfoil extending radially outwardly from said platform and having pressure and suction airfoil sides that define pressure and suction blade sides of said blade; and at least two spaced apart parallel transversely extending bracing ribs in a corner of said shank and said platform between one of said blade sides and said inner surface of said platform.

8. A blade as claimed in claim 7 wherein said bracing ribs, said shank, and said platform are integrally cast.

9. A blade as claimed in claim 8 wherein said bracing ribs have fillets in triangular corners formed by said ribs, platform, and shank.

10. A blade as claimed in claim 9 wherein said ribs includes tapered rib sides that are tapered in a radially inwardly direction away from said platform and in a transverse direction away from said shank.

11. A blade as claimed in claim 10 wherein said one of said blade sides is said pressure side.

12. A blade as claimed in claim 11 further comprising a cooling circuit extending radially outwardly through said dovetail, shank, platform, and airfoil for circulating a coolant therethrough for cooling said blade.

* * * * *